United States Patent [19]

Peterson

[11] 4,413,690

[45] Nov. 8, 1983

[54] WEIGHING CUP

[75] Inventor: Shepard J. Peterson, Anaheim, Calif.

[73] Assignee: FMC Corporation, Chicago, Ill.

[21] Appl. No.: 357,460

[22] Filed: Mar. 12, 1982

[51] Int. Cl.[3] ..... B07C 5/28

[52] U.S. Cl. ..... 177/54; 177/145; 198/504; 209/593

[58] Field of Search ..... 177/52, 54, 59, 145, 177/25; 209/594, 593, 592; 198/504

[56] References Cited

U.S. PATENT DOCUMENTS 3,955,637 5/1976 Del Rosso ..... 177/145

4,254,877 3/1981 Rose ..... 209/594

*Primary Examiner*—Joseph W. Hartary

*Attorney, Agent, or Firm*—Lloyd B. Guernsey; Walter W. Ritt, Jr.; Richard B. Megley

[57] ABSTRACT

An article carrying cup transfers an article along a continuous conveyor from a load zone through a weighing zone to a discharge zone where the article is discharged into areas according to weight. The cup is pulled along by a transverse tow bar loosely pivoted to the cup. At the weighing zone the cup is supported front and rear by weighing pegs which ride on front and rear weigh bars to hold the cup in a horizontal position and with the center of gravity between the weighing pegs to insure accurate weighing of asymmetrical articles. The front and rear weigh bars are positioned so the front and rear pegs transfer onto the corresponding weigh bars at the same time, and transfer off the weigh bars at the same time to maximize the weighing time of a moving cup.

13 Claims, 6 Drawing Figures

WEIGHING CUP

BACKGROUND OF THE INVENTION

1. Field of the Invention

The present invention relates to apparatus for rapidly weighing a large number of articles, and more particularly, to apparatus for accurately weighing such articles irrespective of their orientation as the articles are weighed.

2. Description of the Prior Art

A number of systems have been developed for sorting individual articles, such as fruits or vegetables according to weight. Such systems include a plurality of spaced article receiving cups arranged in single file on a conveyor so that articles pass over a scale fixed in the conveyor channel at a point between a loading zone and a discharge zone. The cups are usually pivotally carried by their proximal ends and weighed by weighing the loose end of each cup, it being assumed that the cavity of each cup will orient a contained article with the center of gravity of the article at the center of the cavity. However, if an article has an irregular shape the article may be weighed lighter or heavier than the actual weight, depending upon whether the center of gravity of the article is toward the front or toward the rear of the center of the cavity of the cup. If the center of gravity of the article is in front of the center of the cup cavity the article will weigh too light because a larger portion of the weight is supported by the pivot, and if the center of gravity is behind the center of the cup cavity the article will register a weight larger than the actual value.

One system for weighing moving articles attempts to alleviate the disadvantages of the pivoted cups by mounting legs at the four corners of a rectangular article receiving cup and allowing the four legs to support the cup by sliding along the length of a pair of bars mounted on a load cell. A disadvantage of the use of the two bars to support the four cup legs is that the two front legs slide along the bars for a considerable distance before the rear legs make contact with the bars. Then the four legs slide along the bars only a short distance before the front legs move off the pair of bars. This provides only a relatively short time for the actual weighing of the article and could cause inaccuracies in weighing as the legs could bounce on the bars before settling down.

SUMMARY OF THE INVENTION

The present invention alleviates some of the disadvantages of the prior art by providing a plurality of spaced article receiving cups arranged in single file on a conveyor with at least one weighing peg mounted to a front portion of the receiving cup and a pair of rear weighing pegs mounted to a rear portion of the receiving cup. A front weight bar mounted on a weighing cell supports the front peg as the cup moves through a weighing zone and a pair of rear weigh bars support the rear pegs at the same time. The front and rear weigh bars are positioned so the front peg moves onto the front bar at the same time that the rear pegs move onto the rear bars. The cups can move a considerable distance while the pegs are all supported by the front and rear weigh bars and still keep a relatively close spacing between adjacent cups on the conveyor. The front and rear pegs are mounted so the center of gravity of the cup and its contents is located between the front and rear pegs to insure an accurate weighing of the article in each cup. If desired a pair of front weighing pegs and a pair of rear weighing pegs can be used with a pair of front bars and a pair of rear bars to simultaneously support the four weighing pegs.

DESCRIPTION OF THE PREFERRED EMBODIMENT

Figure 1:
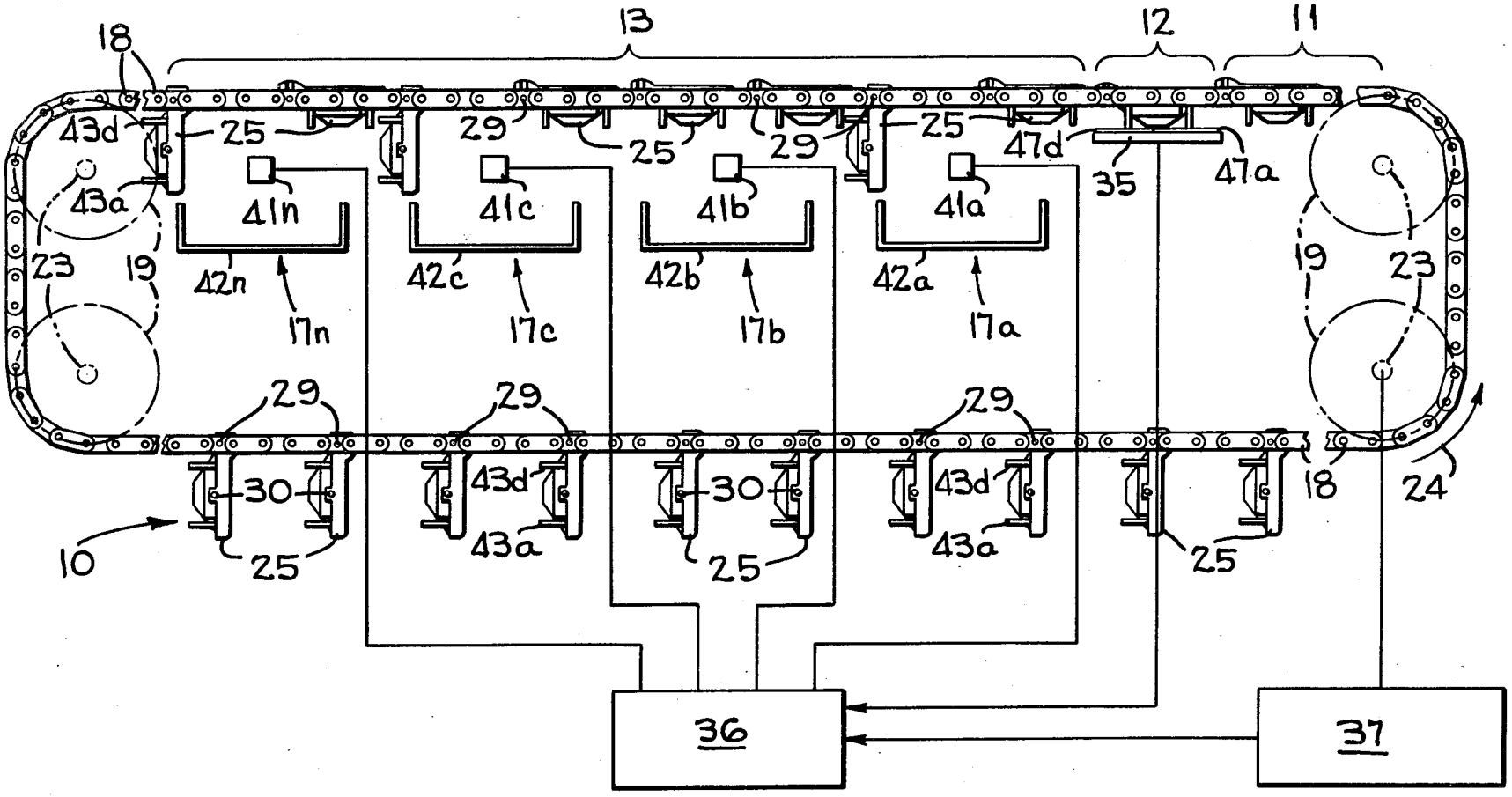
FIG. 1 is a side elevation of a weight sizing apparatus which includes the present invention for weighing articles as they move along a conveyor.

A weight sizing apparatus 10 which uses the weighing apparatus of the present invention is shown in the diagrammatic side elevation of FIG. 1. The sizing apparatus 10 includes a multichannel conveyor which transports articles, such as items of agricultural produce from a loading zone 11, through a weighing zone 12 to a discharge zone 13 where the articles are supplied to any one of a number of discharge stations 17*a*–17*n* according to the weight of the individual item. The articles of produce may be apples, oranges, peaches, avocadoes, potatoes or other types of produce which may be readily sorted according to weight by the apparatus shown. Details of the complete sizing apparatus 10 are not considered important to understand the weighing apparatus of the present invention, but details of such a sizing apparatus can be found in the U.S. Pat. No. 4,254,877, issued Mar. 10, 1981, and assigned to the assignee of the present invention.

The sizing apparatus 10 includes a conveyor having a plurality of endless conveyor chains 18 (only one chain being shown in FIG. 1) which extend about a plurality of sprockets 19 each rotatably mounted to a shaft 23 with one of the sprockets 19 being driven by a motor (not shown) to move the chain in the counterclockwise direction shown by an arrow 24. A plurality of article receiving cups 25 are each connected to the conveyor chains 18 by a tow bar 29. The receiving cups 25 are supported only by the tow bars 29 as the cups hang below the portion of the chain moving from left to right (FIG. 1) at the lower portion of the sizing apparatus 10. A support pin 30 connect to each of the cups 25 rests on the top of a support rail (not shown) mounted parallel to the chain 18 to aid in supporting each cup as the cup moves through the loading zone 11 along the top of the sizing apparatus 10.

Figure 2:
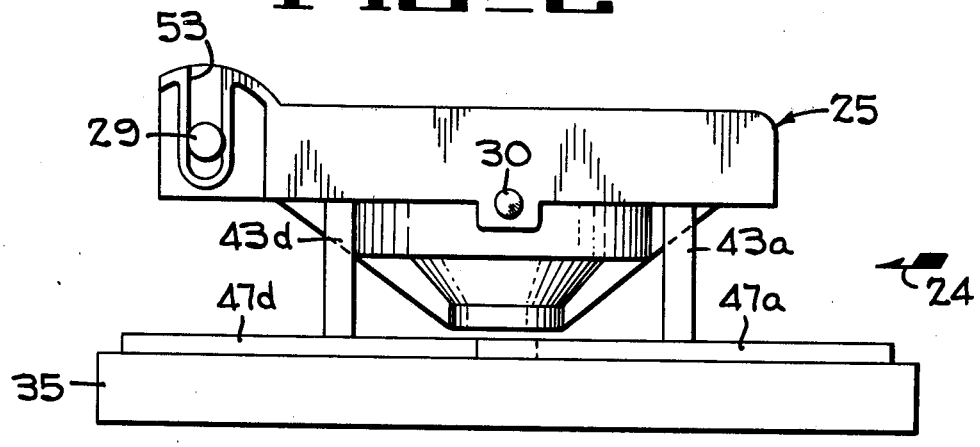
FIG. 2 is an enlarged side elevation of a portion of the apparatus of FIG. 1 and disclosing details of the weighing apparatus of the present invention.
Figure 3:
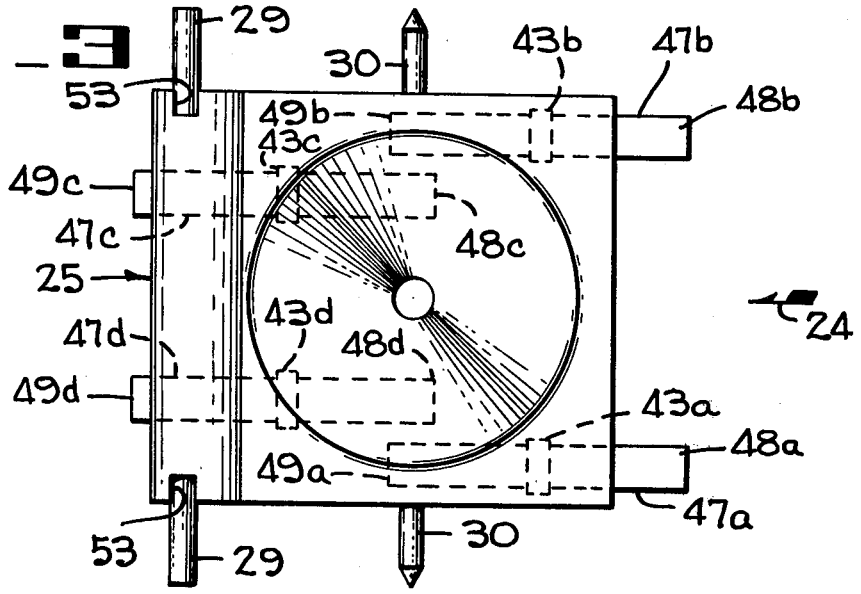
FIG. 3 is a plan view of the weighing apparatus of FIG. 2.

As each cup 25 travels through the weighing zone 12 the cup is supported by a plurality of weigh bars 47*a*–47*d* (FIGS. 2, 3) mounted on a weighing cell 35. The weighing cell 35 provides a weigh signal to a computer 36 (FIG. 1) and the computer 36 uses the weigh signal along with a timing signal from a chain drive encoder 37 to provide signals to one of a plurality of solenoids 41*a*–41*n* to cause the article in the cup to descend into one of a plurality of discharge chutes 42*a*–42*n*.

A plurality of support pegs 43a–43d (FIGS. 1–3) are welded or otherwise secured to a lower portion of each of the article receiving cups 25 to support the cup on the plurality of weigh bars 47a–47d as the cup moves through the weighing zone 12. The pg 43a–43d are spaced apart so the center of gravity of the cup 25 and its contents is between the support pegs. The front weigh bars 43c, 43d (FIG. 3) are mounted on the weighing cell 35 parallel to the rear weigh bars 43a, 43b, with a forward portion 48c, 48d of the front bars 47c, 47d upstream from a trailing portion 49b, 49a of the rear bars 47b, 47a. The support pegs 43a–43d and the weigh bars 47a–47d are positioned so the front support pegs 43c, 43d move onto the forward portion 48c, 48d of the front bars 47c, 47d at the same time that the rear support pegs 43a, 43b move onto the forward portions 48a, 48b of the rear bars 47a, 47b. The support pegs move along the corresponding weigh bars with the entire weight of the cup 25 and its contents supported by the weight bars and by the weighing cell 35 until the pegs 43a–43d move off the weigh bars. The front pegs 43c, 43d move off the trailing portion 49c, 49d of the front weigh bars 47c, 47d at the same time that the rear pegs 43a, 43b move off the trailing portion 49a, 49b of the rear weigh bars 47a, 47b. Thus, the cup 25 and its contents can be continuously weighed as the support pegs move from the forward portion 48a–48d of each weigh bar to the trailing portion 49a–49d of each weigh bar. This relatively long weighing time enables the cup 25 to settle down and slide a relatively long distance along the weigh bars without bouncing. Any bouncing of the cup on the weigh bars is eliminated during the travel along the forward portions of the weigh bars. The cup 25 is pulled through the weighing zone 12 (FIG. 1) by the tow bar 29 (FIG. 2) which is free to move up and down in a slot 53 in the forward portion of the cup 25. This arrangement of the tow bar 29 in the slot 53 eliminates any upward or downward pressure by the tow bar 29 on the cup 25 and insures an accurate weighing of the cup and its contents.

Figure 5:
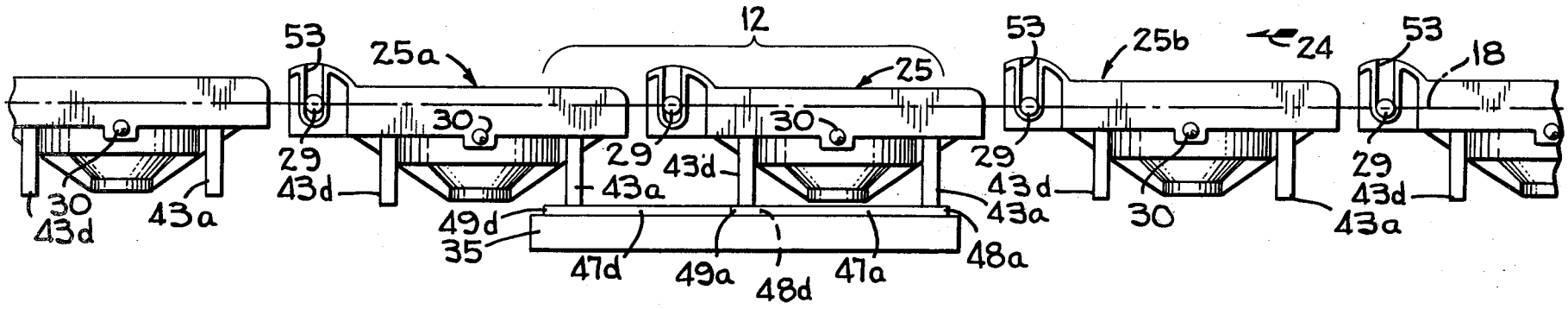
FIGS. 5 and 6 are side elevations of the weight sizing apparatus showing a sequence of operation.
Figure 6:
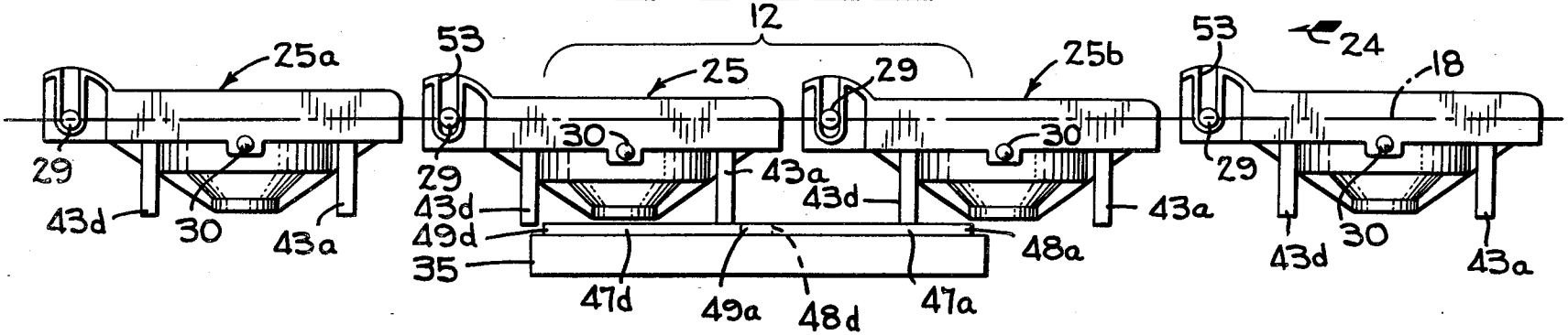

The sequence of moving an article receiving cup from the loading zone into the weighing zone is shown in FIGS. 5 and 6. In FIG. 5 the cup 25 is shown moving into the weighing zone 12 with the front peg 43d on the forward portion 48d of the weigh bar 47d and with the rear peg 43a on the forward portion 48a of the rear weigh bar 47a. The pegs 43c, 43b (FIG. 3) are also supported on portions 48c, 48b at the same time. A leading cup 25a is leaving the weighing zone 12 (FIG. 5) and a trailing cup 25b has not reached the weighing zone. The trailing cup 25b is supported at a level slightly above the level of the cup 25 by the support pins 30 which ride on support rails or other supports (not shown). When a cup reaches the weighing zone 12, the support rails are eliminated so the cup being weighed is supported entirely by the support pegs 43a–43d riding on the weigh bars 47a–47d.

The cup 25 moves through the weighing zone 12 (FIG. 6) until the front pegs 43d, 43c (FIGS. 3, 6) move off the weigh bars 47d, 47c and the rear pegs 43a, 43b move off the weigh bars 47a, 47b. At this time (FIG. 6) the trailing cup 25b is almost ready to move onto the weigh bars 47a–47d and the leading cup 25a has been raised above the weighing level by the support pins 30 which ride along the support rails (not shown).

Figure 4:
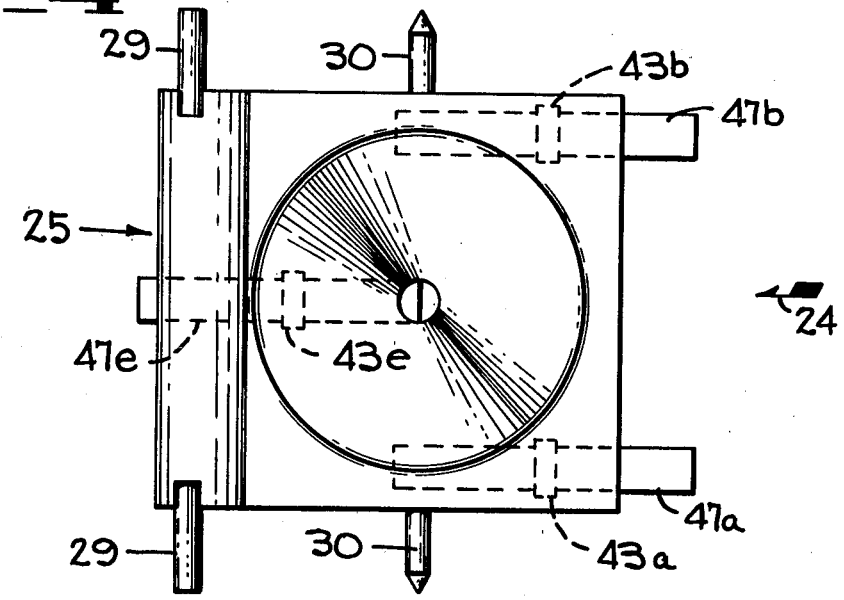
FIG. 4 is a plan view of another embodiment of the weighing apparatus of the present invention.

Another embodiment of the weighing zone 12 is disclosed in FIG. 4 and includes a single front peg 43e which rides on a single weigh bar 47e during the time the cup 25 and its contents are being weighed. The rear portion of the cup 25 is supported by rear pegs 43a, 43b and weigh bars 47a, 47b as in the embodiment shown in FIG. 3. The center of gravity is still between the front peg 43e and the rear pegs 43a, 43b. If desired two front pegs and two corresponding front weigh bars can be used along with a single rear peg and a single rear weigh bar.

The present invention discloses apparatus for providing a relatively long weighing time for moving articles supported by article receiving cups moving in single file along a conveyor and allows the receiving cups to be closely connected to each other. The cups are shown supported by pegs connected to the cups with the pegs supported by weigh bars during the weighing operation, but the cups can also be supported by wheels or other supports connected to the cups.

Although the best mode contemplated for carrying out the present invention has been herein shown and described, it will be apparent that modification and variation may be made without departing from what is regarded to be the subject matter of the invention.

What is claimed is:

1. Apparatus for weighing articles held in spaced article receiving cups arranged in single file on a conveyor, each of the articles being weighed as the corresponding cup moves through a weighing zone, said apparatus providing accurate weighing of each article irrespective of the orientation of the article in the cup, said apparatus comprising:

at least one front weighing peg mounted to a front portion of said receiving cup;

a pair of rear weighing pegs mounted to a rear portion of said receiving cup;

a weighing cell which provides an output signal proportional to a weight supported by said weighing cell;

at least one front weigh bar mounted to said weighing cell to support said front weighing peg as said cup moves through said weighing zone;

a pair of rear weigh bars mounted on said weighing cell to support said rear weighing pegs as said cup moves through said weighing zone; and wherein said front and said rear weigh bars are positioned so said front peg is supported by said front weigh bar at the same time that said rear pegs are supported by said rear weigh bars.

2. Apparatus for weighing articles as defined in claim 1 wherein said front weigh bar and said rear weigh bars are positioned to transfer said front peg onto said front weigh bar at the same time that said rear pegs transfer onto said rear weigh bars, and said front peg moves off said front weigh bar at the same time that said rear pegs move off said rear weigh bars.

3. Apparatus as defined in claim 1 wherein said front peg is supported only by said front weigh bar and said rear pegs are supported only by said rear weigh bars as said cup moves through said weighing zone.

4. Apparatus for weighing articles as defined in claim 1 wherein the center of gravity of said receiving cups and its contents is located between said front and said rear pegs.

5. Apparatus as defined in claim 4 wherein said means for moving includes a moving tow bar mounted in a pair of slots in a front portion of said receiving cup.

6. Apparatus for accurately weighing an article of agricultural produce in a moving transfer cup irrespective of the orientation of said article in said cup as said article moves through a weighing zone, said apparatus comprising:

a pair of front weighing pegs mounted to a front portion of said transfer cup;

a pair of rear weighing pegs mounted to a rear portion of said transfer cup;

a weighing cell which provides an output signal proportional to a weight supported by said weighing cell;

a pair of front weigh bars mounted on said weighing cell to support said front weighing pegs as said cup moves through said weighing zone; and a pair of rear weigh bars mounted on said weighing cell to support said rear weighing pegs as said cup moves through said weighing zone.

7. Apparatus for weighing an article as defined in claim 6 wherein the center of gravity of said transfer cup and its contents is located between said front and said rear pegs.

8. Apparatus as defined in claim 6 wherein said front pegs are supported only by said front weigh bars and said rear pegs are supported only by said rear weigh bars as said cup moves through said weighing zone.

9. Apparatus for weighing an article as defined in claim 6 wherein the total weight of said cup and said article is supported by said bars during the time the cup moves through said weighing zone.

10. Apparatus for weighing an article as defined in claim 6 wherein said front and said rear weigh bars are positioned so said front pegs are supported by said front weigh bars at the same time that said rear pegs are supported by said rear weigh bars.

11. Apparatus for weighing an article as defined in claim 6 including means for moving said transfer cup through said weighing zone without exerting any upward or downward force on said transfer cup.

12. Apparatus as defined in claim 11 wherein said means for moving includes a movable tow bar mounted in a pair of slots in a front portion of said transfer cup.

13. Apparatus for weighing an article as defined in claim 11 wherein said front weigh bars and said rear weigh bars are positioned so said front pegs transfer onto said front weigh bars at the same time that said rear pegs transfer onto said rear weigh bars and said front pegs move off said front weigh bars at the same time that said rear pegs move off said rear weigh bars.

* * * * *